US010203645B2

(12) United States Patent
Iino

(10) Patent No.: US 10,203,645 B2
(45) Date of Patent: Feb. 12, 2019

(54) IMAGE FORMING APPARATUS, METHOD OF CONTROLLING THE SAME, AND STORAGE MEDIUM

(71) Applicant: CANON KABUSHIKI KAISHA, Tokyo (JP)

(72) Inventor: Nozomu Iino, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/411,601

(22) Filed: Jan. 20, 2017

(65) Prior Publication Data

US 2017/0227912 A1 Aug. 10, 2017

(30) Foreign Application Priority Data

Feb. 4, 2016 (JP) ..... 2016-020243

(51) Int. Cl.
*G03G 15/00* (2006.01)

(52) U.S. Cl.
CPC ..... *G03G 15/70* (2013.01); *G03G 15/502* (2013.01)

(58) Field of Classification Search
CPC .. G03G 15/70; G03G 15/502; G03G 15/5012; G03G 15/5016; G03G 15/703; G03G 15/706
See application file for complete search history.

(56) References Cited

U.S. PATENT DOCUMENTS 6,788,902 B2 * 9/2004 Funahashi ..... G06K 15/00 399/11
7,406,271 B2 * 7/2008 Robinson ..... G03G 15/55 399/9
2011/0261102 A1 * 10/2011 Kurasawa ..... B41J 11/002 347/16
2016/0282797 A1 * 9/2016 Hirahara ..... G03G 15/70
2017/0006174 A1 * 1/2017 Miyaji ..... H04N 1/00509

FOREIGN PATENT DOCUMENTS

JP 2000-147850 5/2000

* cited by examiner

*Primary Examiner* — David Banh
(74) *Attorney, Agent, or Firm* — Venable LLP

(57) ABSTRACT

An image forming apparatus determines whether there is a possibility of tearing of the recording material occurring for a recording material. Furthermore, if there is the possibility of paper tearing, the apparatus locks an opening/closing unit related to the occurrence of the tearing of the recording material, displays a first screen indicating that the opening/closing unit is locked, and after the first screen is displayed displays a second screen indicating a procedure in which a jam processing unit is operating for resolving the jam.

32 Claims, 9 Drawing Sheets

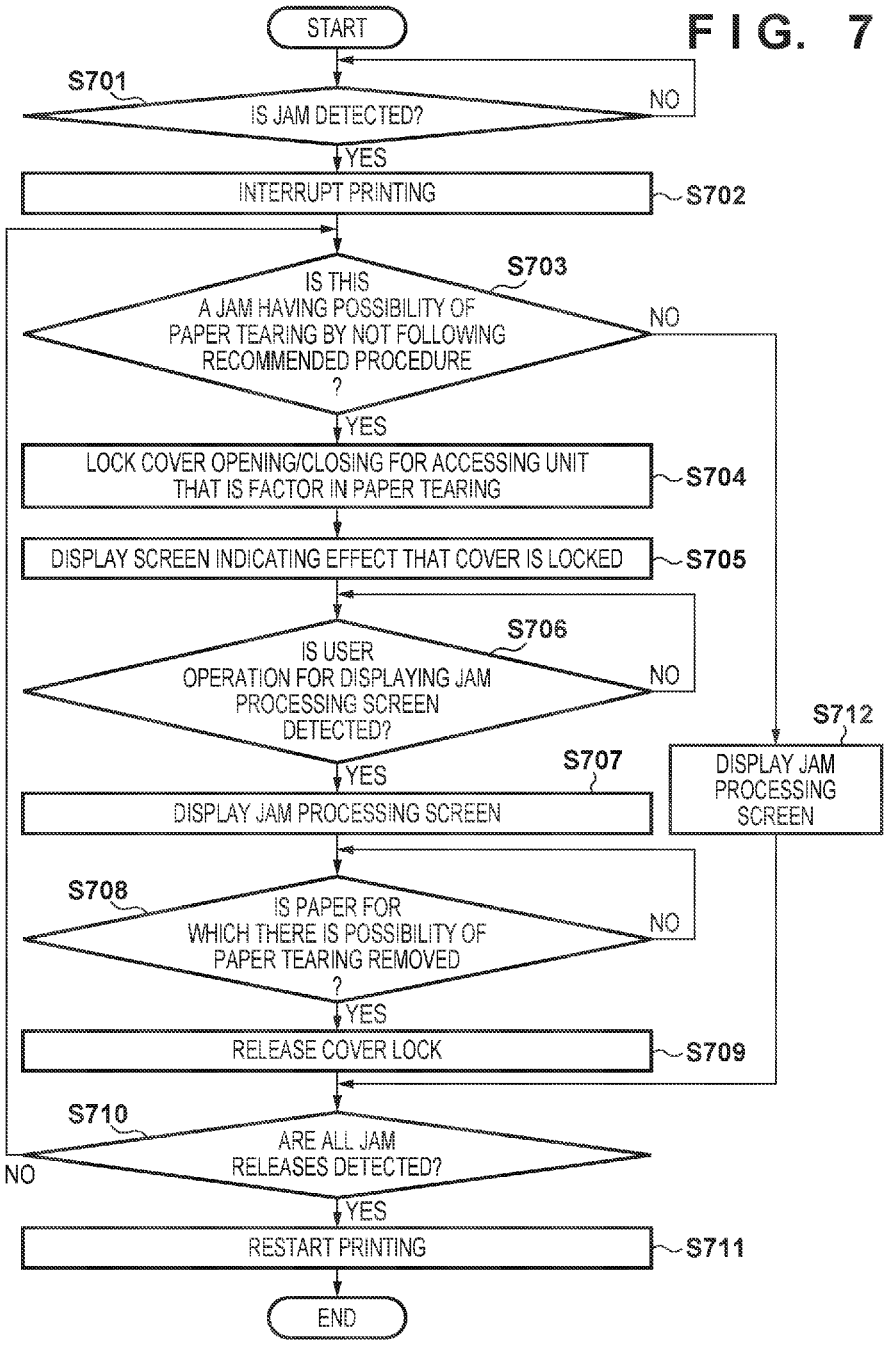
FIG. 7
START
S701
IS JAM DETECTED?
NO
YES
INTERRUPT PRINTING
S702
S703
IS THIS A JAM HAVING POSSIBILITY OF PAPER TEARING BY NOT FOLLOWING RECOMMENDED PROCEDURE ?
NO
YES
LOCK COVER OPENING/CLOSING FOR ACCESSING UNIT THAT IS FACTOR IN PAPER TEARING
S704
DISPLAY SCREEN INDICATING EFFECT THAT COVER IS LOCKED
S705
S706
IS USER OPERATION FOR DISPLAYING JAM PROCESSING SCREEN DETECTED?
NO
YES
S707
DISPLAY JAM PROCESSING SCREEN
S712
DISPLAY JAM PROCESSING SCREEN
S708
IS PAPER FOR WHICH THERE IS POSSIBILITY OF PAPER TEARING REMOVED ?
NO
YES
RELEASE COVER LOCK
S709
S710
ARE ALL JAM RELEASES DETECTED?
NO
YES
RESTART PRINTING
S711
END

IMAGE FORMING APPARATUS, METHOD OF CONTROLLING THE SAME, AND STORAGE MEDIUM

BACKGROUND OF THE INVENTION

Field of the Invention

The present invention relates to an image forming apparatus having a function of, when a conveyance error such as a jam has occurred, efficiently giving guidance for a work procedure for a release thereof, a method of controlling the same, and a storage medium.

Description of the Related Art

For an image forming apparatus such as a copying machine or a printer, a jam may occur at a conveyance route of sheets. For release of the jam, an operation for opening a cover of the image forming apparatus and removing a sheet that is a cause of the jam is necessary.

However, in accordance with a location where the jam occurred, there may be a necessity to follow a predetermined procedure when releasing the jam. If the procedure is not followed, there is the possibility that the sheet that jammed tears, and remains in the device as is to thereby give rise to a jam repeatedly. Although a maintenance screen illustrating a jam occurrence position and a procedure for releasing the jam is displayed on an operation unit at a time of the jam, it is conceivable that a user will perform jam processing without looking at the operation unit.

Japanese Patent Laid-Open No. 2000-147850 proposes an apparatus that physically locks covers so that a user should follow a predetermined procedure and not be able to open covers other than those in the procedure.

However, there is a problem as is recited below in the foregoing conventional technique. However, in the above conventional technique, although covers are physically locked, there is a possibility that a user does not realize that. In such a case, there is a possibility of the device breaking if a user attempts to force a cover open. In contrast, to cause a jam to be appropriately processed, controlling so that it is not possible to open a cover other than that in the procedure is useful.

SUMMARY OF THE INVENTION

The present invention enables realization of a mechanism for, at the time of a jam, preventing a breakage of an apparatus while causing a user to perform appropriate jam processing, by presenting to the effect that a cover or the like is locked to the user before presenting to the user a processing procedure for resolving the jam.

One aspect of the present invention provides an image forming apparatus, comprising: a sensor configured to detect a recording material conveyed; a memory device that stores a set of instructions; and at least one processor that executes the instructions to: detect an occurrence of a jam by using the sensor, determine from a detection result of the sensor whether there is a possibility of tearing of a retained recording material in an operation to a jam processing unit that is operated for resolving a jam, and upon determining that there is a possibility of tearing of the retained recording material in a case that an occurrence of a jam is detected, lock an opening/closing unit included in the jam processing unit and related to the tearing of the retained recording material, display on an operation unit a first screen indicating that the opening/closing unit is locked, and, after the first screen is displayed, display on the operation unit a second screen indicating a procedure in which the jam processing unit is operated for resolving the jam.

Another aspect of the present invention provides a method of controlling an image forming apparatus provided with a sensor configured to detect a conveyed recording material, the method comprising: detecting an occurrence of a jam by using the sensor, determining from a detection result of the sensor whether there is a possibility of tearing of recording material occurring for a retained recording material in an operation to a jam processing unit that is operated for resolving a jam, and upon determining that there is a possibility of tearing of the retained recording material in a state that an occurrence of a jam is detected, locking opening/closing unit included in the jam processing unit and related to the occurrence of the tearing of the retained recording material, displaying on an operation unit a first screen indicating that opening/closing unit is locked, and, after the first screen is displayed, displaying on the operation unit a second screen indicating a procedure in which the jam processing unit is operated for resolving the jam.

Still another aspect of the present invention provides a non-transitory computer-readable storage medium storing a computer program for causing a computer to execute each step of a method of controlling an image forming apparatus provided with a sensor configured to detect a conveyed recording material, the method comprising: detecting an occurrence of a jam by using the sensor, determining from a detection result of the sensor whether there is a possibility of tearing of a retained recording material occurring for the retained recording material in an operation to a jam processing unit that is operated for resolving a jam, and upon determining that there is a possibility of tearing of the retained recording material in a case that an occurrence of a jam is detected, locking an opening/closing unit included in the jam processing unit and related to the occurrence of the tearing of the retained recording material, displaying on an operation unit a first screen indicating that the opening/closing unit is locked, and, after the first screen is displayed, displaying on the operation unit a second screen indicating a procedure in which the jam processing unit is operating for resolving the jam.

Further features of the present invention will be apparent from the following description of exemplary embodiments with reference to the attached drawings.

BRIEF DESCRIPTION OF THE DRAWINGS

FIG. 7 is a view illustrating a flowchart according to embodiments.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Configuration of Image Forming Apparatus

Figure 1:
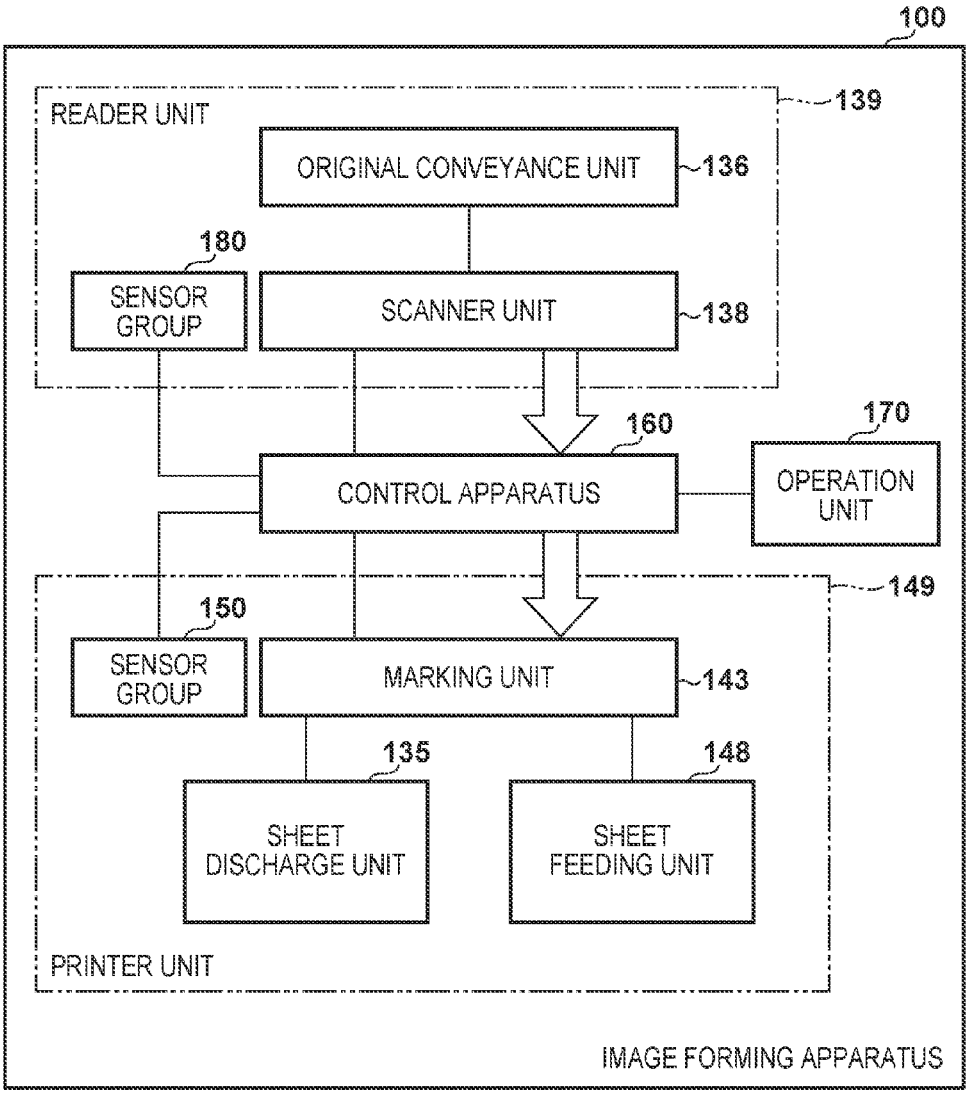
FIG. 1 is a block diagram illustrating a configuration of an image forming apparatus 100 according to embodiments.

Below, explanation will be given for a first embodiment of the present invention. Firstly, with reference to FIG. 1, explanation is given regarding a configuration of an image forming apparatus according to an embodiment of the present invention. As illustrated in FIG. 1, an image forming apparatus 100 is provided with a reader unit 139, a printer unit 149, a control apparatus 160, and an operation unit 170.

The reader unit 139 has an original conveyance unit 136 for conveying an original, a scanner unit 138 for reading an image on an original conveyed from the original conveyance unit 136, and a sensor group 180. Image data read by the scanner unit 138 is input to the control apparatus 160. The sensor group 180 is a plurality of sensors provided at important positions of a conveyance path, provided in the reader unit 139, for conveying an original, and, in addition to controlling a conveyance timing of an original, can detect the existence or absence of an original or the occurrence of a jam. If occurrence of a jam is detected by the sensor group 180, a screen depicting an occurrence position and a release method of the jam is displayed on the operation unit 170.

The printer unit 149 has a sheet feeding unit 148, a marking unit 143, a sheet discharge unit 135, and a sensor group 150. The sheet feeding unit 148 is equipped with a plurality of cassettes each accommodating recording sheets (recording material) of respectively different sizes, and feeds a recording sheet from each cassette. The marking unit 143 is a unit having an image forming process by an electrophotographic method. In the marking unit 143, image forming is performed on a recording sheet fed from the sheet feeding unit 148, based on the image data input from the scanner unit 138 via the control apparatus 160.

Figure 5:
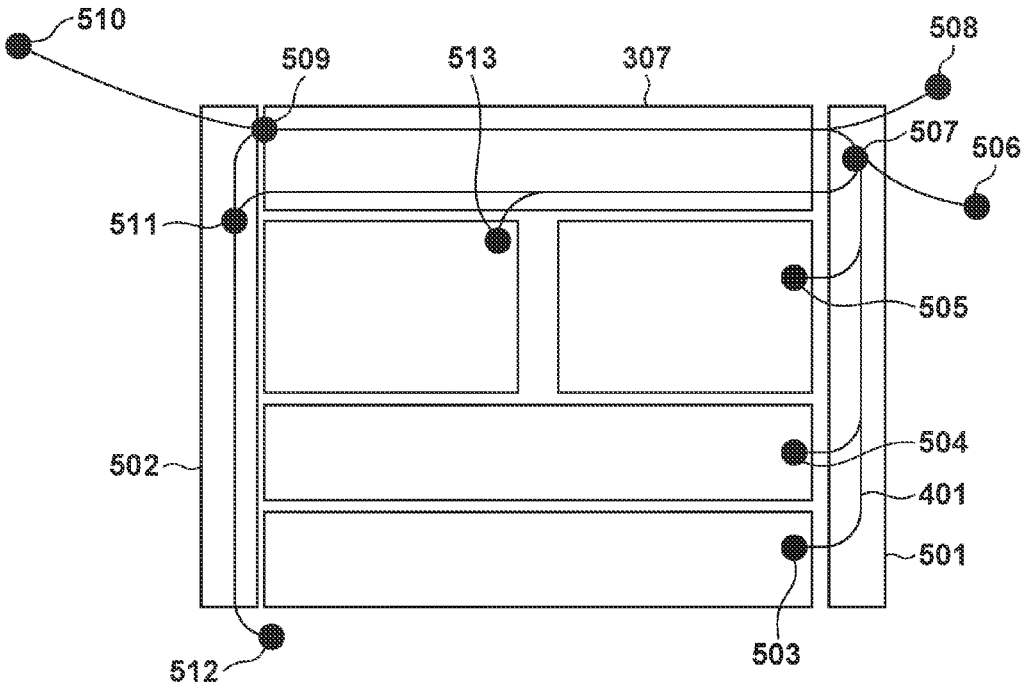
FIG. 5 is a view for illustrating, in more detail than FIG. 4, conveyance paths of conveyance routes of a recording sheet of the image forming apparatus 100 according to embodiments.

The sheet discharge unit 135 performs processing such as sorting or stapling recording sheets on which images are formed by the marking unit 143, and discharges them to the outside of the apparatus. The sensor group 150 is a plurality of sensors provided at important positions of a conveyance path, provided in the printer unit 149, for conveying a recording sheet, and, in addition to controlling a conveyance timing of the recording sheet, can detect the occurrence of a jam. If occurrence of a jam is detected by the sensor group 150, a screen 505 of later-described FIG. 5 depicting an occurrence position and a release method of the jam is displayed on the operation unit 170.

The control apparatus 160 is electronically connected to the reader unit 139 and the printer unit 149. The control apparatus 160 realizes a copy function by controlling so as to read image data of an original by the reader unit 139, output this image data to the printer unit 149, and form an image on a recording sheet. The operation unit 170 has a liquid crystal display panel for displaying various keys and a user interface screen for performing, for example, instruction input with respect to the control apparatus 160, generates a corresponding signal in accordance with an operation of the various keys, and outputs it to the control apparatus 160.

Control Apparatus Configuration

Figure 2:
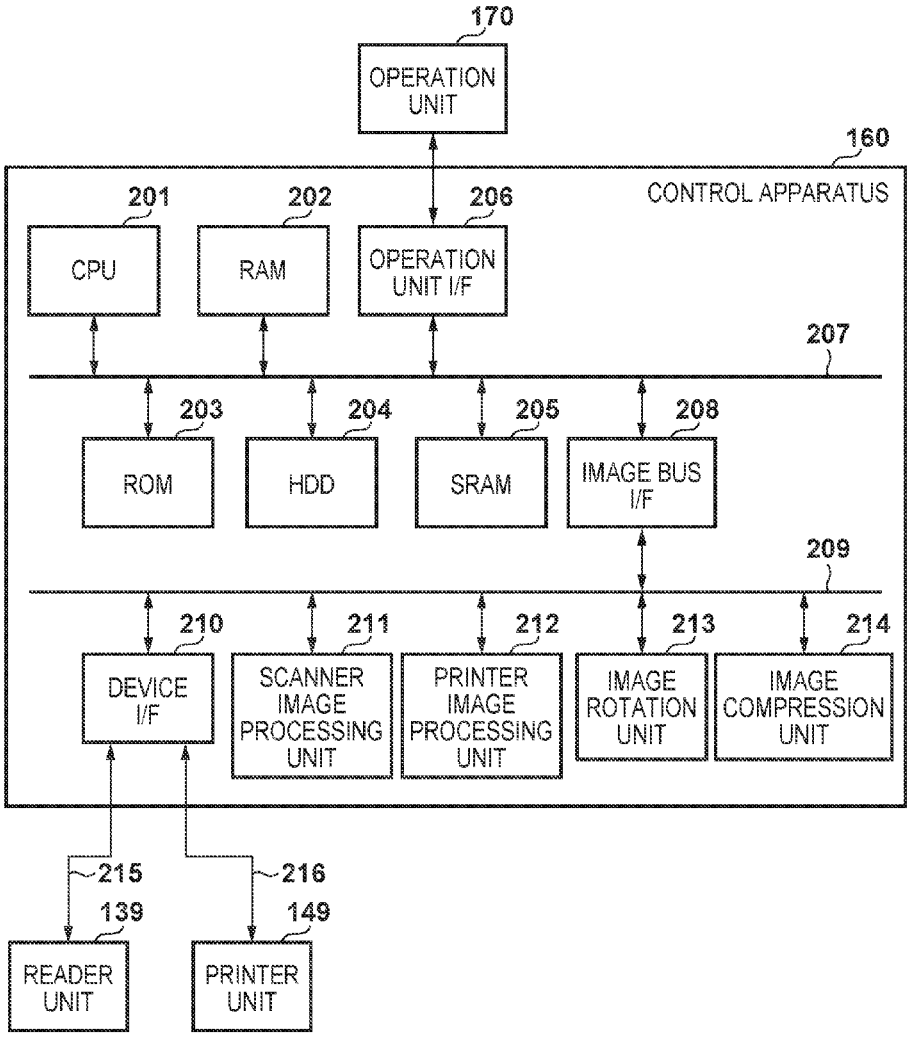
FIG. 2 is a block diagram illustrating a configuration of a control apparatus 160 according to embodiments.

Next, with reference to FIG. 2, explanation is given regarding a detailed configuration of the control apparatus 160. The control apparatus 160 is provided with, on a system bus 207, a CPU 201, a RAM 202, a ROM 203, an HDD 204, an SRAM 205, an operation unit I/F 206, and an image bus I/F 208. Furthermore, the control apparatus 160 is provided with, on an image bus 209, a device I/F 210, a scanner image processing unit 211, a printer image processing unit 212, an image rotation unit 213, and an image compression unit 214.

The CPU 201 comprehensively controls the system overall. The RAM 202 is a system work memory for the CPU 201 to operate, and is an image memory for temporarily storing image data. The ROM 203 has a boot ROM, and stores a boot program for the system. In addition, a ROM-for-data in the ROM 203 is a non-volatile memory for which writing and deleting of stored content electronically is possible, is an EEPROM for example, and can store various data described later, or the like. The hard disk drive (HDD) 204 stores system software or image data. The operation unit I/F 206 is an interface unit with the operation unit 170, and outputs to the operation unit 170 image data that should be displayed on the operation unit 170. In addition, information input by a user is conveyed to the CPU 201 via the operation unit 170.

The device I/F 210 is connected to the reader unit 139 and the printer unit 149, and converts image data into a synchronous system or an asynchronous system. The scanner image processing unit 211 performs image processing such as noise reduction, shifting, masking/trimming, enlargement/reduction, tone conversion or the like in accordance with an instruction from the CPU 201 with respect to image data. The printer image processing unit 212 performs image processing such as correction, resolution conversion, or the like, with respect to image data. The image rotation unit 213 performs rotation processing with respect to image data. The image compression unit 214 performs JPEG compression/decompression processing for multi-value image data, and performs compression/decompression processing such as JBIG, MMR, MR, or MH for binary image data.

Figure 6A:
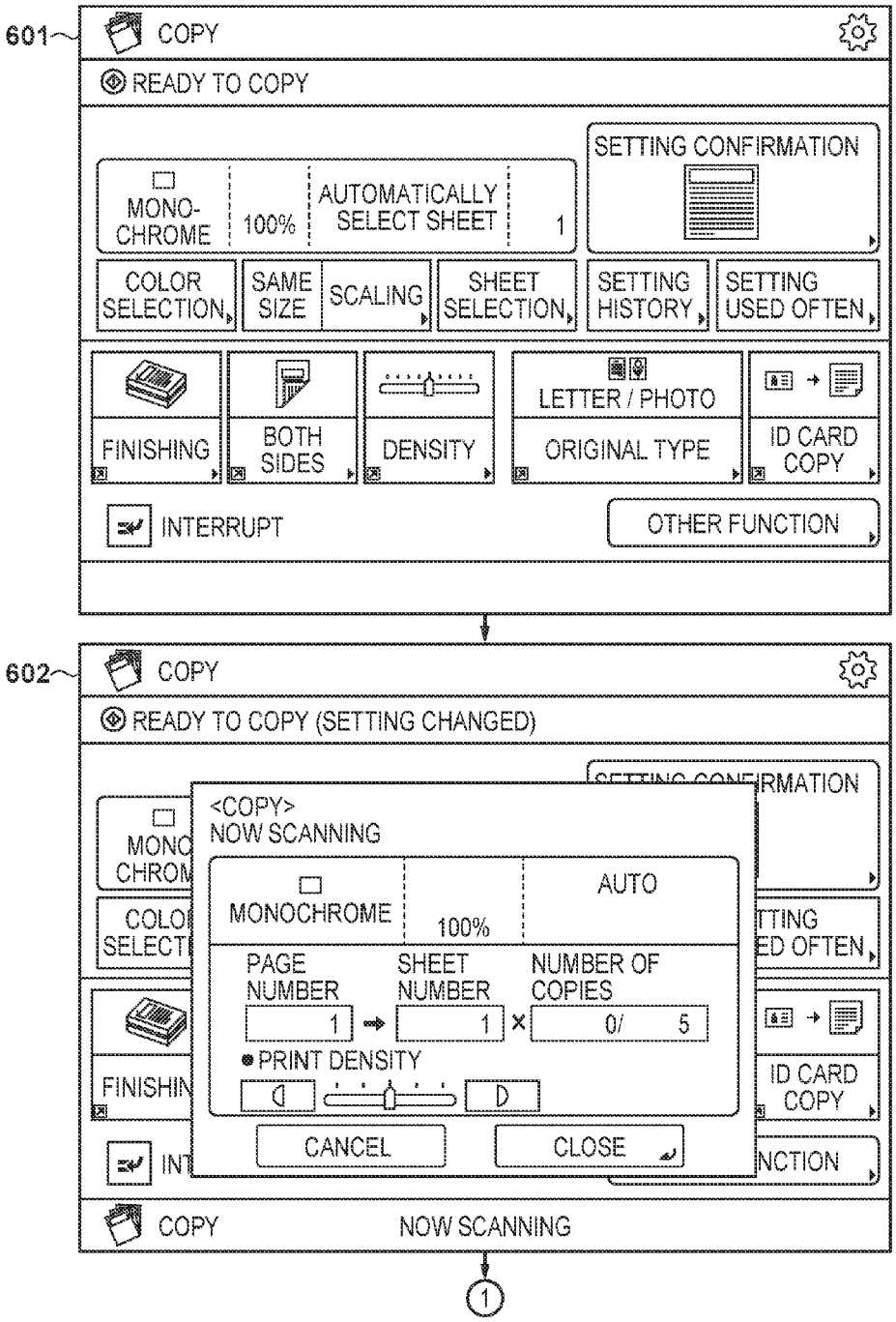
FIGS. 6A-6C are schematic diagrams that illustrate an example of screen transitions of a maintenance screen that is displayed on an operation unit 170 according to embodiments.
Figure 6B:
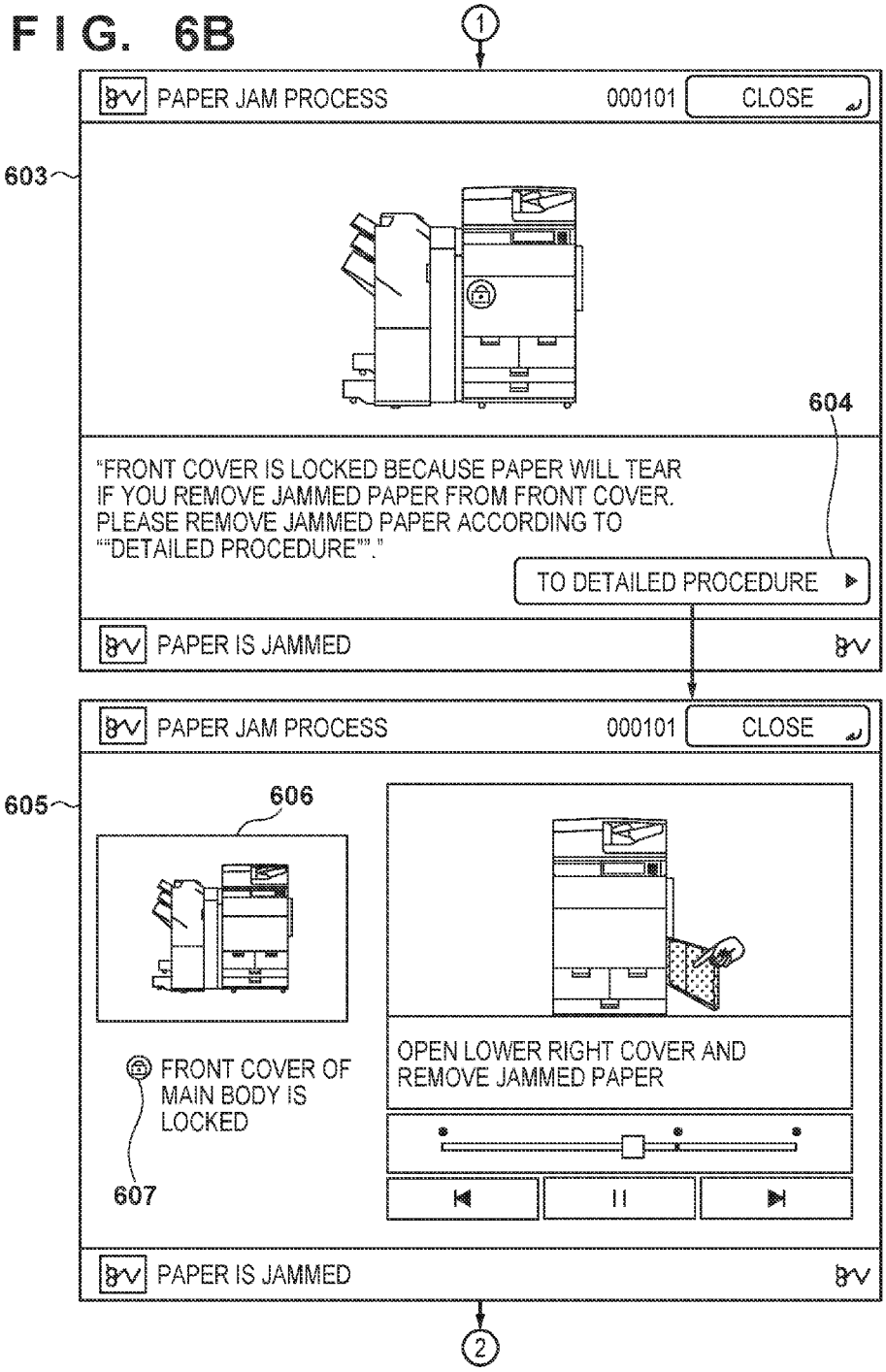
Figure 6C:
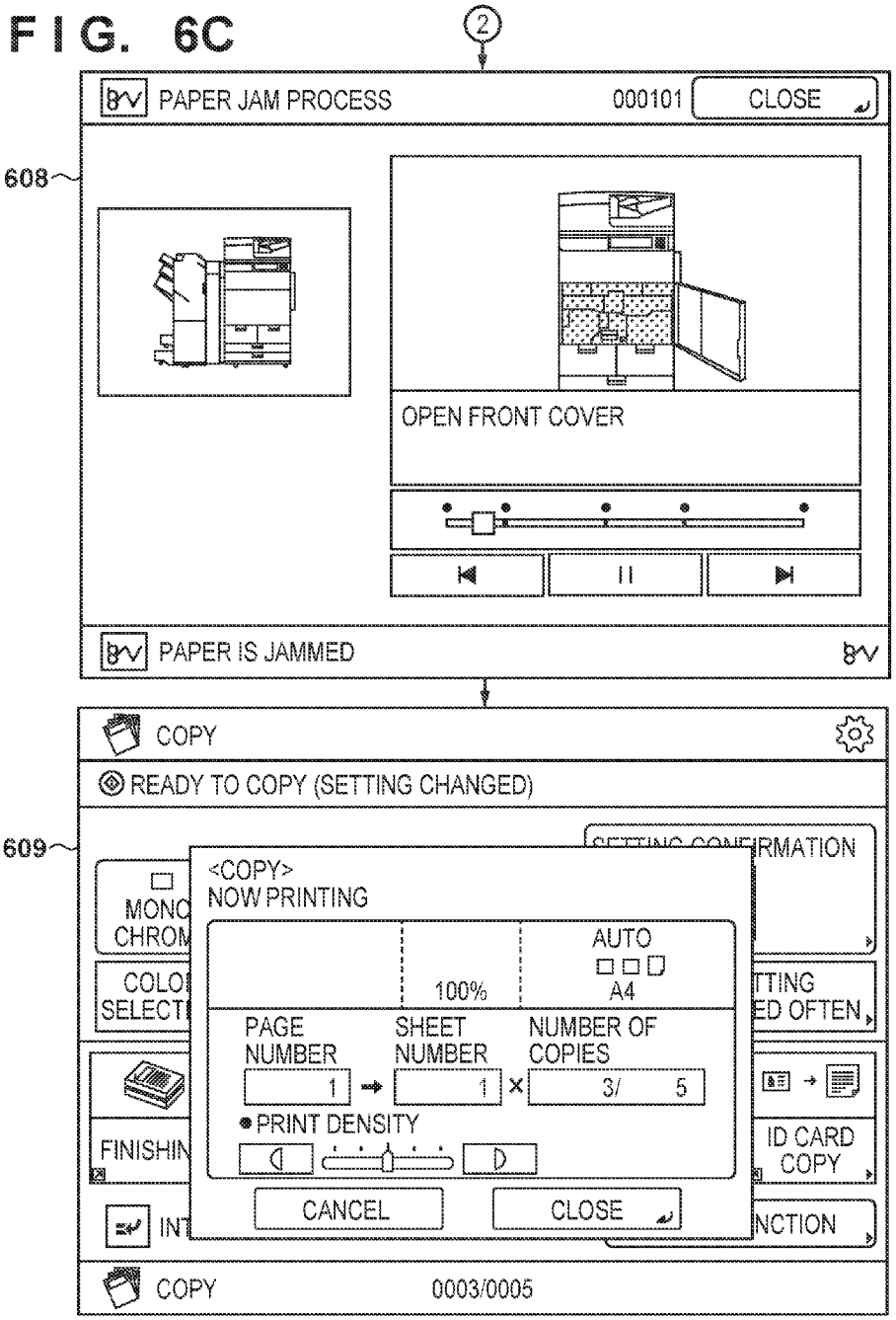

Note that the CPU 201 comprehensively controls access between various devices connected to the system bus 207, based on, for example, a control program stored in the HDD 204 or a ROM-for-program in the ROM 203. It reads input information from the reader unit 139 which is connected via a reader unit interface 215, and outputs an image signal as output information to the printer unit 149 which is connected via a printer unit interface 216. In addition, a later-described display control procedure that is illustrated by FIGS. 6A-6C is realized by reading the control program stored in the HDD 204 or the ROM-for-program in the ROM 203 into the RAM 202, and the CPU 201 processing based on the control program.

Device Configuration Example

Figure 3:
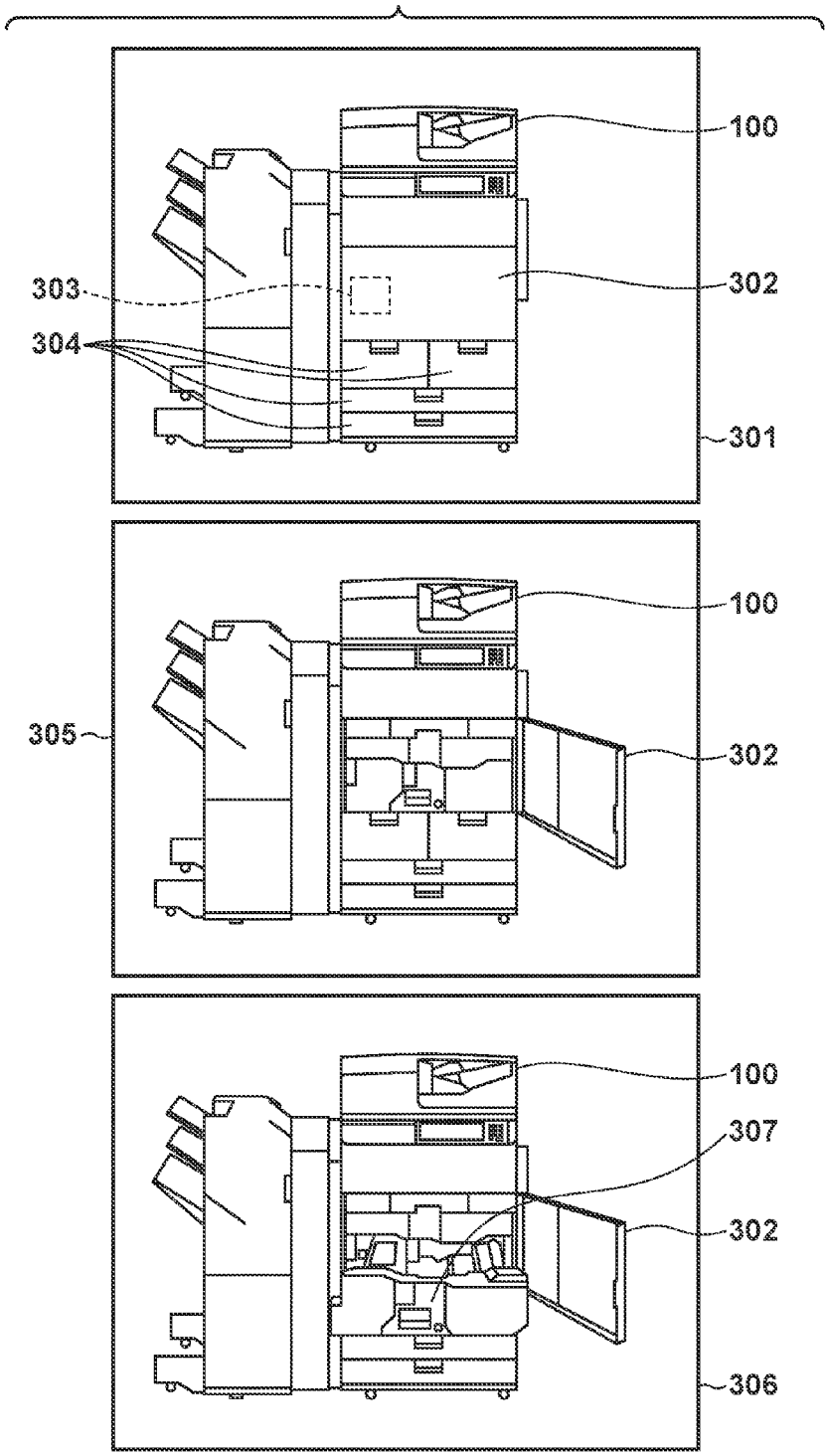
FIG. 3 is views illustrating examples of a device configuration of the image forming apparatus 100 according to embodiments.

Next, with reference to FIG. 3, explanation is given regarding an example of a device configuration of an image forming apparatus according to embodiments. FIG. 3 is views in which the image forming apparatus 100 is seen from the front.

Reference numeral 301 depicts a device state for when all covers are normally closed. Reference numeral 302 depicts a front cover of an image forming apparatus. Reference numeral 303 depicts a lock mechanism of the front cover. Reference numeral 304 depicts a sheet feeding unit.

Reference numeral 305 depicts a state in which the front cover 302 is open. Reference numeral 306 depicts a state in which a fixing conveyance unit 307 is further pulled out from the state of reference numeral 305. When pulling out the fixing conveyance unit 307, there is the possibility that paper tearing arises due to a retention position of the recording sheet. The retention position of the recording sheet is detected by the sensor group 150 of the printer unit 149, and if the CPU 201 determines from the detection result that the recording sheet is being retained at a position having the possibility for paper tearing to arise, opening/closing of the front cover 302 is locked by the lock mechanism of reference numeral 303.

When locking the front cover 302, the CPU 201 presents to a user a screen 603 indicating that opening/closing of the front cover is locked that is illustrated in FIG. 5, which is described later, by displaying it on the operation unit 170. In addition, if the CPU 201 determines from the detection result of the sensor group 150 of the printer unit 149 that there is no possibility of paper tearing, the CPU 201 presents to a user a screen 605 illustrating a jam occurrence position of FIG. 5 which is described later and a release method, by displaying it on the operation unit 170.

In accordance with the present embodiment, the lock mechanism uses a solenoid unit, and opening/closing of the cover is locked by supplying the solenoid unit with power. However, the present invention is not limited to this, and another method may be used if it can achieve the objective of locking. If opening/closing of the front cover 302 is locked, there is a necessity to perform jam processing from a left side of the main body or a right side of the main body.

Jam Having Possibility of Paper Tearing

Figure 4:
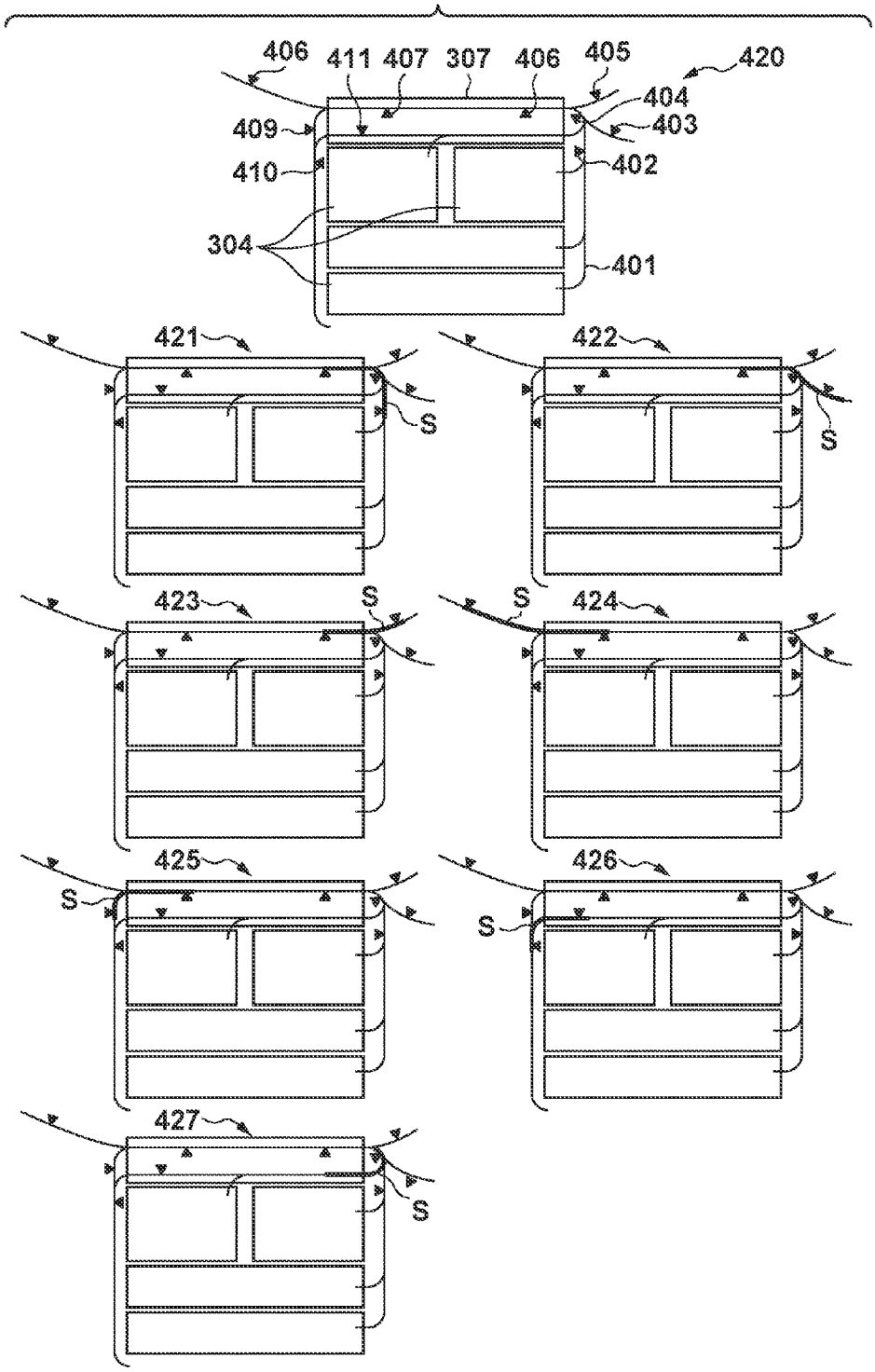
FIG. 4 is views illustrating conveyance routes of a recording sheet of the image forming apparatus 100 according to embodiments and retention positions of a recording sheet when paper tearing occurs due to a user operation.

Next, with reference to FIG. 4, explanation is given regarding conveyance routes of a device configuration of an image forming apparatus according to embodiments, and a jam for which there is the possibility of paper tearing arising. The views more simply illustrate the image forming apparatus illustrated in FIG. 4 than the main body portion of the image forming apparatus 100 illustrated in FIG. 3, and similarly to FIG. 3, reference numeral 304 indicates a sheet feeding unit, and reference numeral 307 indicates a fixing conveyance unit.

Reference numeral 401 depicted in reference numeral 420 depicts a conveyance route of a recording sheet, and reference numerals 402 to 411 each depict a sensor in the sensor group 150 that is arranged on the conveyance path 401 of the recording sheet. Description is given later by FIG. 5 regarding the conveyance path of the recording sheet. Reference numerals 421 to 427 depict cases in which paper tearing arises when a user pulls out the fixing conveyance unit 307, and S of each view indicates a retention position of a recording sheet conveyed from a sheet feeding unit. In this way, when the fixing conveyance unit 307 is pulled out, paper tearing occurs at various retention positions of a recording sheet when a jam occurs. Accordingly, if a recording sheet is retained at such a position, there is a necessity to lock opening/closing of a door for pulling out the fixing conveyance unit 307, and present that to a user.

Note that, as illustrated by reference numerals 421 to 427, the image forming apparatus 100 confirms at the time of a jam occurrence which sensor of the sensors 402 to 411 is detecting a recording sheet. Because of this, it is possible to confirm the retention position of a recording sheet when a jam occurs. For example, in reference numeral 421, it is understood that the sensors 402, 404, and 406 are detecting the recording sheet. In other words, the image forming apparatus 100 determines whether there is a possibility for paper tearing to occur in accordance with a pattern of sensors that are detecting the recording sheet. Accordingly, it is desirable to control such that information of patterns for which there is the possibility of paper tearing to occur is held in advance, and if a pattern when a jam occurs matches a held pattern, determine that there is the possibility of paper tearing.

Conveyance Path

Next, with reference to FIG. 5, explanation is given regarding a recording sheet conveyance path of the image forming apparatus 100 according to the present embodiment. Reference numeral 501 depicts a recording sheet conveyance route on a right side of the main body. Reference numeral 502 depicts a recording sheet conveyance route on a left side of the main body. Reference numerals 503 to 513 depict points on a conveyance path that is recited for explaining in detail the conveyance path out of conveyance routes of the recording sheet indicated by reference numeral 401 in FIG. 4. Below, reference numbers 503 to 513 are used to give an explanation regarding conveyance paths of a recording sheet.

Reference number 503, 504, 505, and 513 each depict a conveyance position of a recording sheet conveyed from a respective unit of the cassettes 304 illustrated by FIG. 3. In the image forming apparatus 100 according to the present embodiment, it is possible to optionally add another sheet feeding unit to a right side of the main body, and connect it to the main body. If an optional sheet feeding unit is connected to the right side of the main body and sheet feeding is performed from the optional sheet feeding unit, a recording sheet is fed inside the device through the conveyance path 506. When feeding is performed from a manual feed unit, a recording sheet is fed inside the device through the conveyance path 508. Reference numeral 510 is a conveyance path through which a conveyed recording sheet is passed when being conveyed to the sheet discharge unit.

In a case of performing printing on only one side, a recording sheet fed from any of reference numerals 503, 504, 505, 506, and 513 is discharged to reference numeral 510 passing through reference numerals 507 and 509. A recording sheet fed from the manual feed unit is discharged toward reference numeral 510 passing through reference numerals 508 and 509. Meanwhile, in a case of performing printing on both sides, a recording sheet fed from any of reference numerals 503, 504, 505, 506, 508, and 513 passes through reference numeral 509 similarly to a case of printing on only one side, but is not conveyed toward reference numeral 510, and the sheet is caused to invert by reference numeral 512 after passing through reference numeral 511. Subsequently, a path is taken in which the sheet passes through reference numeral 511 again, and is discharged toward reference numeral 510 after passing through reference numerals 507 and 509.

Paper tearing the fixing conveyance unit 307 being pulled out can be classified by broadly dividing into two cases. There is the case in which a recording sheet is retained at a position that spans the recording sheet conveyance path 501 on the right side of the main body and conveyance routes in the fixing conveyance unit 307 (corresponds to reference numerals 421, 422, 423, and 427 in FIG. 4). Furthermore, there is the case in which a recording sheet is retained at a position that spans the recording sheet conveyance path 502 on the left side of the main body and conveyance routes in the fixing conveyance unit 307 (corresponds to reference numerals 424, 425, and 426 in FIG. 4).

Method of Detecting Possibility of Paper Tearing

A method of detecting whether there is the possibility of paper tearing arising is discussed below. As the detection method, the CPU 201 determines which position a recording sheet is retained at from a length of time each sensor of reference numerals 402 to 411 in FIG. 4 is ON for, and decides whether there is the possibility of paper tearing arising from the retention position of the recording sheet.

In the present embodiment, if the sensor 402 is ON and a distance from a leading edge of a recording sheet that is being retained to the sensor 402 is 40 mm or more, it is determined that the recording sheet is being retained in a form such as that of reference numeral 421 in FIG. 4. In other words, the CPU 201 determines that the recording sheet is being retained at a position that spans the recording sheet conveyance path 501 of the right side of the main body and conveyance routes in the fixing conveyance unit 307, and locks the front cover 302 by the lock mechanism 303.

Similarly, if the sensor 403 is on and a distance from a leading edge of a recording sheet that is being retained to the sensor 403 is 70 mm or more, the CPU 201 determines that the recording sheet is being retained in a form such as that of reference numeral 422 in FIG. 4. In addition, if the sensor 405 is ON and a distance from a leading edge of a recording sheet that is being retained to the sensor 405 is 70 mm or more, the CPU 201 determines it to be the state of reference numeral 423 in FIG. 4. In addition, if the sensor 407 is ON and a distance from a leading edge of a recording sheet that is being retained to the sensor 407 is 50 mm or more, the CPU 201 determines it to be the state of reference numerals 424 and 425 in FIG. 4. In addition, if the sensor 410 is ON and a distance from a leading edge of a recording sheet that is being retained to the sensor 410 is 90 mm or more, the CPU 201 determines it to be the state of reference numeral 426 in FIG. 4.

The foregoing explained an example in which the CPU 201 determines the distance between the leading edge of a recording sheet that is being retained and each sensor. However, the present invention is not limited to this, and there is also a method in which the CPU 201 determines a distance between a rear end of a recording sheet and the sensors 402 to 411 after considering the size of the recording sheet and the length of the conveyance route, to determine whether the recording sheet is being retained at a position for which there is a possibility of paper tearing arising. In the present embodiment, if the sensor 404 is ON and a distance from a trailing edge of a recording sheet that is being retained to the sensor 404 is 80 mm or more, the CPU 201 determines it to be the state of reference numerals 421, 422, and 427 in FIG. 4.

Similarly, if the sensor 406 is ON and a distance from a trailing edge of a sheet that is being retained to the sensor 406 is 60 mm or more, the CPU 201 determines it to be the state of reference numerals 421, 422, and 423 in FIG. 4. If the sensor 408 is ON and a distance from a trailing edge of a sheet that is being retained to the sensor 408 is 110 mm or more, the CPU 201 determines it to be the state of reference numeral 424 in FIG. 4. If the sensor 409 is ON and a distance from a trailing edge of a sheet that is being retained to the sensor 409 is 70 mm or more, the CPU 201 determines it to be the state of reference numeral 425 in FIG. 4. If the sensor 411 is ON and a distance from a trailing edge of a sheet that is being retained to the sensor 411 is 50 mm or more, the CPU 201 determines it to be the state of reference numeral 426 in FIG. 4.

Jam Processing Procedure

Next, with reference to FIGS. 6A-6C, explanation is given regarding a jam processing procedure for when a jam has occurred. FIGS. 6A-6C illustrate an example of a screen transition of a maintenance screen displayed on the operation unit 170 in a case where the CPU 201 has determined that paper tearing will arise from a detection result of the sensor group 150 of the printer unit 149.

Reference numeral 601 is a standard copy screen displayed on the operation unit 170. In a state where the screen illustrated by reference numeral 601 is displayed, if the CPU 201 detects that a start key (not shown) has been pressed, a currently executing copy screen depicted by reference numeral 602 is displayed on the operation unit 170. If the sensor group 150 of the printer unit 149 detects the occurrence of a jam in the state in which the screen depicted by reference numeral 602 is displayed, and the CPU 201 detects that this jam is a jam for which there is the possibility of paper tearing in due to a recommended procedure not being followed, the CPU 201 stops conveyance of the recording sheet.

Next, the CPU 201 locks opening/closing of the front cover 302 by the lock mechanism 303, and displays on the operation unit 170 a screen (a first screen), which indicates that opening/closing of the front cover is locked, that is depicted by reference numeral 603. In a state where the screen depicted by reference numeral 603 is displayed, if the CPU 201 detects that a "To Detailed Procedure" key 604 has been pressed, the CPU 201 displays on the operation unit 170 a screen (a second screen) 605 that indicates an occurrence position and a release method for the jam.

In reference numeral 605, work details for removing a recording sheet retained on a conveyance route of a right side surface of the main body and an illustration indicated by reference numeral 606 that notifies an occurrence position of the jam are displayed, and a message 607 that indicates that opening/closing of the front cover of the main body is locked is displayed. If there is no information for reference numeral 605, a user cannot start processing to resolve a jam. Accordingly, ordinarily, when a jam occurs, a user focuses on a screen of the operation unit 170 until the information of reference numeral 605 is displayed. Accordingly, because that opening/closing of the cover is locked is conveyed by reference numeral 603 before reference numeral 605 is displayed, a user can easily confirm the presentation. Because of this, it is possible to reduce a number of users who do not realize that opening/closing of the cover is locked, and it is possible to prevent the cover from breaking due to forcibly opening or closing the cover.

The CPU 201 distinguishes whether release of jammed paper for which there is the possibility of paper tearing is detected, by the sensor group 150 of the printer unit 149 in the state in which the screen depicted by reference numeral 605 is displayed. If the CPU 201 distinguishes that release of jammed paper for which there is the possibility of paper tearing has been performed, the CPU 201 unlocks (releases) opening/closing of the front cover 302 which had been locked by the lock mechanism 303. Furthermore, the CPU 201 displays on the operation unit 170 a screen 608 that indicates work details for removing a recording sheet that is retained on a conveyance route behind the front cover of the main body. Note that, because opening/closing of the front cover 302 is unlocked in the screen 608, the message 607 that is displayed by the screen 605 and that conveys that opening/closing of the front cover is locked is hidden.

In the state in which the screen 608 is displayed, if it is detected by the sensor group 150 of the printer unit 149 that all jammed paper has been released, the CPU 201 displays the currently executing copy screen depicted by reference numeral 609 on the operation unit 170, and the guidance terminates.

Display Control Procedure

Next, with reference to FIG. 7, explanation is given regarding a display control procedure by the CPU 201 in the present embodiment. FIG. 7 is a flowchart that is executed when the CPU 201 detects the occurrence of a jam in the sensor group 150 of the printer unit 149 of the sensor group 180 of the reader unit 139 illustrated in FIG. 1, after accepting an execution request for printing. The CPU 201 executes each step illustrated in the flowchart of FIG. 7 by executing a control program stored in the HDD 204 or the ROM-for-program of the ROM 203.

Firstly, upon accepting an execution request for printing, the CPU 201 starts the processing illustrated by the flowchart of FIG. 7. For example, if a copy execution request for printing by the printer unit 149 an image of an original read by the reader unit 139 is accepted, the CPU 201 performs the processing of this flowchart. In addition, if a print execution request for printing by the printer unit 149 an image accepted from an external PC is accepted, the CPU 201 performs the processing of this flowchart.

In step S701, the CPU 201 determines whether the occurrence of a jam is detected in the sensor group 150 of the printer unit 149 or the sensor group 180 of the reader unit 139. If it is determined that the occurrence of a jam is detected, the CPU 201 advances processing to step S702. If it is determined that occurrence of a jam is not detected, this determination is periodically repeated.

In step S702, the CPU 201 interrupts printing and advances the processing to step S703. In step S703, the CPU 201 determines whether this is a jam for which there is a possibility of paper tearing occurring by not following a procedure recommended from the detection information of the sensor group 150 of the printer unit 149 or the sensor group 180 of the reader unit 139. If it is determined to be a jam for which there is a possibility of paper tearing, the CPU 201 advances the processing to step S704, and if it is determined that there is no possibility of paper tearing, the CPU 201 advances the processing to step S712.

In step S704, the CPU 201 supplies power to the solenoid unit of the lock mechanism 303 to lock the front cover 302. Next, in step S705, the CPU 201 displays on the operation unit 170 the screen 603 indicating to the effect that opening/closing of the cover is locked as illustrated in FIG. 6B, and advances the processing to step S706. In step S706, the CPU 201 determines whether there was an instruction for switching display to the screen 605 that indicates the occurrence position and release method of a jam as illustrated in FIG. 5.

In step S706, if it is determined that the "To Detailed Procedure" key 604 of the screen 603 that indicates to the effect that opening/closing of the cover is locked as illustrated in FIG. 6B has been pressed, the CPU 201 advances the processing to step S707. If not being pressed is determined, this determination is periodically repeated.

In step S707, the CPU 201 displays on the operation unit 170 the screen 605 indicating the occurrence position and release method of the jam as illustrated in FIG. 6B, and advances the processing to step S708. In step S708, the CPU 201 determines whether release of a jammed sheet for which there is a possibility of paper tearing is detected in the sensor group 150 of the printer unit 149 illustrated in FIG. 1. If it is determined that a release is detected, processing proceeds to step S709. If a release is not detected, this determination is periodically repeated. In step S709, the CPU 201 stops the supply of power to the solenoid unit of the lock mechanism 303 to release the lock of the opening/closing of the front cover 302, and advances the processing to step S710.

In step S710, the CPU 201 determines whether the release of the jam is detected in the sensor group 150 of the printer unit 149 or the sensor group 180 of the reader unit 139 illustrated in FIG. 1. If it is determined that release of the jam is detected, the CPU 201 advances processing to step S711, and if it determined that release of the jam is not detected, the CPU 201 returns processing to step S703. In step S711, the CPU 201 closes the screens 605 to 608 that indicate the occurrence position and release method of a jam as illustrated in FIG. 6C, restarts printing, and terminates this processing.

Meanwhile, if it is determined to be a jam for which there is no possibility of paper tearing in step S703, in step S712 the CPU 201 displays on the operation unit 170 the screen 608 that illustrates an occurrence position and release method for the jam as illustrated in FIG. 6C, and advances the processing to step S710. In other words, in such a case, because there is no necessity to lock opening/closing of the front cover 302, the screen 608 is displayed without displaying the screen 603 that indicates to that effect, on the operation unit 170.

As explained above, the image forming apparatus according to the present embodiment is provided with a plurality of sensors for detecting a position on conveyance routes of a recording material that is being conveyed, and the plurality of sensors are used to detect the occurrence of a jam. Furthermore, if an occurrence of a jam is detected, the present image forming apparatus determines from a detection result of the plurality of sensors whether there is a possibility of paper tearing occurring for a recording material retained during resolution processing for resolving the jam. Furthermore, if there is the possibility of paper tearing, the present image forming apparatus locks opening/closing of a mechanism related to the occurrence of the paper tearing, displays on an operation unit a first screen indicating that opening/closing of the mechanism is locked, and subsequently displays on the operation unit a second screen that explains a processing procedure for processing to resolve the jam. Because of this, a user needs to check a screen indicating that opening/closing of the cover is locked before checking an occurrence position of the jam. Accordingly, efficient work support to a user becomes possible without breakage of a cover, fixing conveyance unit, or the like.

Note, for the present invention various modifications are possible and it is not limited to the embodiments described above. For example, in the above embodiment, paper tearing by pulling out the fixing conveyance unit 307 is envisioned, and while opening/closing of the front cover 302 is locked, configuration may be taken to lock opening/closing of the fixing conveyance unit itself such that the fixing conveyance unit 307 cannot be pulled out.

In addition, there are cases in which paper tearing arises other than by pulling out the fixing conveyance unit 307. It is also possible for paper tearing to occur by pulling out the cassette 304 for example. In such a case, configuration may be taken to control such that opening/closing of the cassette 304 is locked and cannot be opened until the CPU 201 determines from a detection result of the sensor group 150 of the printer unit 149 that a sheet that is a cause of the paper tearing is removed. In addition, without limitation to the printer unit 149, if it is determined that paper tearing has arisen in the reader unit 139, similar control may be performed such as to lock opening/closing of a cover of the reader unit.

In addition, in the above embodiment, explanation was given regarding control for displaying on the operation unit 170 a screen indicating that opening/closing of the front cover 302 is locked, but configuration may be taken to present something to that effect to a user by audio, either alternatively or additionally. In such a case, control may be taken so as to stop output of the audio upon accepting a predetermined user input. Because of this, it is possible to more reliably present to a user that the front cover 302 is locked.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-020243 filed on Feb. 4, 2016, which is hereby incorporated by reference herein in its entirety.

What is claimed is:

1. An image forming apparatus, comprising:

a sensor configured to detect a recording material conveyed;

a memory device that stores a set of instructions; and at least one processor that executes the instructions to:

detect an occurrence of a jam by using the sensor, determine from a detection result of the sensor whether there is a possibility of tearing of a retained recording material in an operation to a jam processing unit that is operated for resolving a jam, and upon determining that there is a possibility of tearing of the retained recording material in a case that an occurrence of a jam is detected, lock an opening/closing unit included in the jam processing unit and related to the tearing of the retained recording material, display on an operation unit a first screen indicating that the opening/closing unit is locked, and, after the first screen is displayed, display on the operation unit a second screen indicating a procedure in which the jam processing unit is operated for resolving the jam.

2. The image forming apparatus according to claim 1, wherein the at least one processor further executes the instructions to upon accepting a predetermined user input after displaying the first screen on the operation unit, display the second screen on the operation unit.

3. The image forming apparatus according to claim 1, wherein the at least one processor further executes the instructions to while displaying the second screen on the operation unit, determine whether the recording material for which there is a possibility of tearing of the retained recording material occurring from the detection result of the sensor has been removed, and upon determining that the recording material is removed, release the lock of the opening/closing unit.

4. The image forming apparatus according to claim 3, wherein while the opening/closing unit is locked, the second screen displays to that effect, and when locking of the opening/closing unit is released, sets the display to that effect to hidden.

5. The image forming apparatus according to claim 1, wherein the jam processing unit further comprises a plurality of movable units, wherein the at least one processor further executes the instructions to, if there is a retained recording material spanning the plurality of units, determine that there is the possibility of tearing of the retained recording material occurring.

6. The image forming apparatus according to claim 1, wherein the locked opening/closing unit is a pulling out unit in which the recording material for which there is a possibility of tearing of the recording material occurring is retained, or a cover that is opened to pull out the pulling out unit.

7. The image forming apparatus according to claim 6, wherein the pulling out unit for which the recording material for which there is a possibility of tearing of the recording material occurring is retained includes a fixing conveyance unit for causing an image to be fixed to the recording material.

8. The image forming apparatus according to claim 1, wherein after the recording material for which there is a possibility of tearing of the retained recording material occurring is removed, the procedure indicated by the second screen includes an opening of the opening/closing unit.

9. A method of controlling an image forming apparatus provided with a sensor configured to detect a conveyed recording material, the method comprising:

detecting an occurrence of a jam by using the sensor, determining from a detection result of the sensor whether there is a possibility of tearing of recording material occurring for a retained recording material in an operation to a jam processing unit that is operated for resolving a jam, and upon determining that there is a possibility of tearing of the retained recording material in a state that an occurrence of a jam is detected, locking opening/closing unit included in the jam processing unit and related to the occurrence of the tearing of the retained recording material, displaying on an operation unit a first screen indicating that opening/closing unit is locked, and, after the first screen is displayed, displaying on the operation unit a second screen indicating a procedure in which the jam processing unit is operated for resolving the jam.

10. A non-transitory computer-readable storage medium storing a computer program for causing a computer to execute each step of a method of controlling an image forming apparatus provided with a sensor configured to detect a conveyed recording material, the method comprising:

detecting an occurrence of a jam by using the sensor, determining from a detection result of the sensor whether there is a possibility of tearing of a retained recording material occurring for the retained recording material in an operation to a jam processing unit that is operated for resolving a jam, and upon determining that there is a possibility of tearing of the retained recording material in a case that an occurrence of a jam is detected, locking an opening/closing unit included in the jam processing unit and related to the occurrence of the tearing of the retained recording material, displaying on an operation unit a first screen indicating that the opening/closing unit is locked, and, after the first screen is displayed, displaying on the operation unit a second screen indicating a procedure in which the jam processing unit is operating for resolving the jam.

11. An image forming apparatus, comprising:

a sensor configured to detect a recording material conveyed;

an opening/closing unit;

a memory device that stores a set of instructions; and at least one processor that executes the instructions to:

detect an occurrence of a jam by using the sensor;

determine whether or not the opening/closing unit is to be locked;

lock the opening/closing unit based on detecting the occurrence of the jam, in a case where it is determined that the opening/closing unit is to be locked upon occurring the jam; and display, on an operation unit, information indicating that the opening/closing unit has been locked and information indicating a procedure for recovering the jam in a case where the jam occurs and it is determined that the opening/closing unit is to be locked.

12. The image forming apparatus according to claim 11, wherein the at least one processor further executes the instructions to determine whether or not the opening/closing unit is to be locked based on a detection result by the sensor.

13. The image forming apparatus according to claim 11, wherein the at least one processor further executes the instructions to display, on the operation unit, a first screen indicating that the opening/closing unit has been locked in a case where the jam occurs and it is determined that the opening/closing unit is to be locked, and then display, on the operation unit, a second screen indicating a procedure for recovering the jam.

14. The image forming apparatus according to claim 11, wherein the at least one processor further executes the instructions to, upon accepting a predetermined user input after displaying, on the operation unit, the first screen indicating that the opening/closing unit has been locked, display, on the operation unit, the second screen indicating the procedure for recovering the jam.

15. The image forming apparatus according to claim 11, wherein the at least one processor further executes the instructions to display simultaneously, on the operation unit, information indicating that the opening/closing unit has been locked and information indicating a procedure for recovering the jam in a case where the jam occurs and it is determined that the opening/closing unit is to be locked.

16. The image forming apparatus according to claim 11, wherein the opening/closing unit is an extraction unit extracted from a main body of the image forming apparatus.

17. The image forming apparatus according to claim 11, further comprising an extraction unit that is extracted from a main body of the image forming apparatus, and wherein the opening/closing unit is a cover that is opened to extract the extraction unit.

18. The image forming apparatus according to claim 11, wherein, after not determining that the opening/closing unit is to be locked, the displayed procedure for recovering the jam includes an opening of the opening/closing unit.

19. The image forming apparatus according to claim 11, wherein the at least one processor further executes the instructions to display, on the operation unit, information indicating that the opening/closing unit has been locked in response to a detection of the occurrence of the jam.

20. An image forming apparatus, comprising:

a conveyance unit configured to convey a recording material along a conveyance path;

an image forming unit configured to form an image on the recording material;

a sensor configured to detect a recording material on the conveyance path;

a cover that is be opened for pulling out the conveyance unit from a main body of the image forming apparatus;

a lock mechanism configured to lock the cover;

a processor that executes the following process:

detecting an occurrence of a jam in the conveyance path;

specifying a retention position of a recording material on the conveyance path by using the sensor in a case where the occurrence of the jam is detected;

controlling the lock mechanism to lock the cover based on the retention position of the recording material on the conveyance path; and displaying, on an operation unit, first information indicating that the cover has been locked and second information indicating a procedure for recovering the jam in a case where the occurrence of the jam is detected.

21. The image forming apparatus according to claim 20, wherein the cover is a front cover provided at a front face of the image forming apparatus.

22. The image forming apparatus according to claim 20, wherein the conveyance unit is a fixing conveyance unit.

23. The image forming apparatus according to claim 20, wherein in a case where the retention position of the recording material retained during the jam occurs is a position across the conveyance path of the conveyance unit and other conveyance path, the processor controls the lock mechanism to lock the cover.

24. The image forming apparatus according to claim 20, further comprising:

a feeding unit configured to feed a recording material to the image forming unit, and wherein in a case where the retention position of the recording material retained during the jam occurs is a position across the conveyance path of the conveyance unit and a conveyance path of the feeding unit, the processor controls the lock mechanism to lock the cover.

25. The image forming apparatus according to claim 20, further comprising:

a discharging unit configured to discharge a recording material on which an image is formed by the image forming unit, and wherein in a case where the retention position of the recording material retained during the jam occurs is a position across the conveyance path of the conveyance unit and a conveyance path of the discharging unit, the processor controls the lock mechanism to lock the cover is locked.

26. The image forming apparatus according to claim 20, further comprising:

a double-sided conveyance path that feeds a recording material of which an image is formed on one surface to the image forming unit, and wherein in a case where the retention position of the recording material retained during the jam occurs is a position across the conveyance path of the conveyance unit and the double-sided conveyance path, the processor controls the lock mechanism to lock the cover.

27. The image forming apparatus according to claim 20, wherein in a case where the jam occurs, the second information is displayed on the operation unit after displaying the first information.

28. The image forming apparatus according to claim 20, wherein in a case where the jam occurs, the first information and the second information is simultaneously displayed on the operation unit after displaying the first information.

29. The image forming apparatus according to claim 27, wherein the processor displays the first information and the second information on the operation unit in a case where the retention position of the recording material retained during the jam occurs is a first retention position, and displays the second information on the operation unit without displaying the first information in a case where the retention position of the recording material retained during the jam occurs is a second retention position.

30. The image forming apparatus according to claim 20, wherein

The processor controls the lock mechanism to cancel the lock of the cover and stops displaying the first information after the recording material retained on the conveyance path is removed.

31. The image forming apparatus according to claim 20, wherein the lock mechanism locks the cover so that the cover is not opened from the main body of the image forming apparatus.

32. An image forming apparatus, comprising:

a conveyance unit configured to convey a recording material along a conveyance path;

an image forming unit configured to form an image on the recording material;

a sensor configured to detect a recording material on the conveyance path;

a cover that is be opened for pulling out the conveyance unit from a main body of the image forming apparatus;

a lock mechanism configured to lock pullout of the conveyance unit;

a processor that executes the following process:

detecting an occurrence of a jam in the conveyance path;

specifying a retention position of a recording material on the conveyance path by using the sensor in a case where the occurrence of the jam is detected;

controlling the lock mechanism to lock the cover based on the retention position of the recording material on the conveyance path; and displaying, on an operation unit, first information indicating that the cover has been locked and second information indicating a procedure for recovering the jam in a case where the occurrence of the jam is detected.

* * * * *